US006595624B1

(12) United States Patent
Silverbrook et al.

(10) Patent No.: US 6,595,624 B1
(45) Date of Patent: Jul. 22, 2003

(54) ACTUATOR ELEMENT

(75) Inventors: Kia Silverbrook, Balmain (AU); Gregory John McAvoy, Balmain (AU)

(73) Assignee: Silverbrook Research Pty Ltd, Balmain (AU)

( * ) Notice: Subject to any disclaimer, the term of this patent is extended or adjusted under 35 U.S.C. 154(b) by 0 days.

(21) Appl. No.: 09/556,219

(22) Filed: Apr. 24, 2000

(30) Foreign Application Priority Data

Apr. 22, 1999 (AU) ..... PP9932

(51) Int. Cl.[7] ..... B41J 2/04
(52) U.S. Cl. ..... 347/54
(58) Field of Search ..... 347/20, 44, 47, 347/54, 70; 251/11; 310/306, 307; 337/140, 141, 139

(56) References Cited

U.S. PATENT DOCUMENTS 5,231,306 A * 7/1993 Meikle et al. ..... 257/751
5,619,177 A * 4/1997 Johnson et al. ..... 337/140
5,838,351 A * 11/1998 Weber ..... 347/65

FOREIGN PATENT DOCUMENTS

EP 0 690 329 A2 3/1996 ..... G02B/26/08

* cited by examiner

*Primary Examiner*—John Barlow
*Assistant Examiner*—Juanita Stephen

(57) ABSTRACT

An actuator element forming a portion of a micro electromechanical device and which comprises a movable arm that is connected at one end to a substrate and which is formed at least in part from a titanum-aluminium nitride composition. The actuator element forms a component of a thermal actuator which, in a particular embodiment of the invention, is actuated to drive a paddle within a printhead ejector and so displace ink from the ejector.

4 Claims, 1 Drawing Sheet

ACTUATOR ELEMENT

FIELD OF THE INVENTION

This invention relates to an actuator element which forms a portion of a micro electro-mechanical device. The invention is herein described in the context of an ink jet printer but it will be appreciated that the application does have application to other micro electro-mechanical devices such as micro electro-mechanical pumps.

BACKGROUND OF THE INVENTION

Micro electro-mechanical devices are becoming increasingly well known and normally are constructed by the employment of semi-conductor fabrication techniques. For a review of micro-mechanical devices consideration may be given to the article "The Broad Sweep of Integrated Micro Systems" by S. Tom Picraux and Paul J. McWhorter published December 1998 in IEEE Spectrum at pages 24 to 33.

One type of micro electro-mechanical device is the ink jet printing device from which ink is ejected by way of an ink ejection nozzle chamber. Many forms of the ink jet printing device are known. For a survey of the field, reference is made to an article by J Moore, "Non-Impact Printing: Introduction and Historical Perspective", Output Hard Copy Devices, Editors R Dubeck and S Sherr, pages 207–220 (1988).

A new form of ink jet printing has recently been developed by the present applicant, this being referred to as Micro Electro Mechanical Inkjet (MEMJET) technology. In one embodiment of the MEMJET technology, ink is ejected from an ink ejection nozzle chamber by a paddle or plunger which is moved toward an ejection nozzle of the chamber by an electro-mechanical actuator for ejecting drops of ink from the ejection nozzle chamber.

The present invention relates to an actuator element for use as an integrated component in the MEMJET technology and in other micro electro-mechanical devices.

SUMMARY OF THE INVENTION

The invention may be broadly defined as providing an actuator element as a portion of a micro electro-mechanical device, wherein the actuator element comprises a movable arm that is connected at one end to a substrate and which is formed at least in part from a titanium-aluminium nitride composition. The aluminium preferably is present in an amount not greater than 55% of the total titanium-aluminium composition and most preferably is present in an amount equal to about 20% of the total titanium-aluminium composition.

The movable arm of the actuator element preferably is formed by a sputter process as one step in a semi-conductor structure fabrication process. More specifically, the movable arm of the actuator element may be formed by reactively sputtering material from a titanium-aluminium alloy in the presence of nitrogen gas.

DETAILED DESCRIPTION OF THE INVENTION

Figure 1:
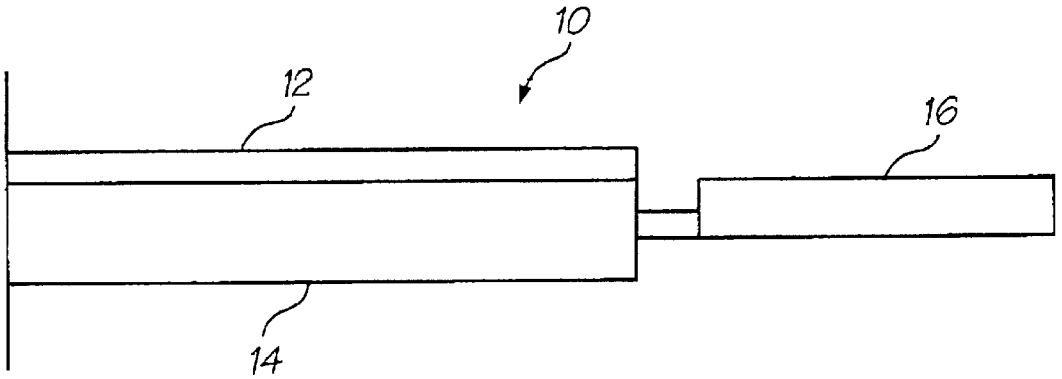
FIG. 1 shows a schematic side view of an actuator element, in accordance with the invention, in a quiescent condition.
Figure 2:
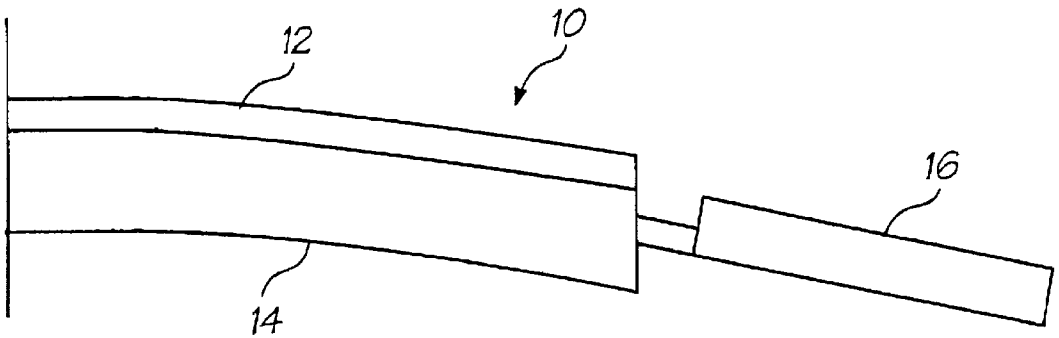
FIG. 2 shows a schematic side view of the actuator element of FIG. 1, in an operative condition.

In FIGS. 1 and 2, reference numeral 10 generally indicates an actuator element, in accordance with the invention. The actuator element 10 of the present invention in its preferred form is fabricated as a part of a printhead ink ejector from which ink is ejected by actuation of a thermal actuator. The thermal actuator includes first and second arms, 12, 14, which are interconnected in a manner such that they are caused to bend, as shown in FIG. 2, when electrical current is passed through the first arm 12, causing the first arm 12 to be heated and to expand relative to the second arm 14.

The first and second arms 12, 14 are coupled to a movable element such as a paddle 16 within an ink ejector nozzle, and bending of the arms 12, 14 causes displacement of the movable element and consequential ejection of ink from the nozzle.

For a more detailed description of the above arrangement, reference may be made to International Patent Application No. PCT/AU00/00095 filed on Feb. 11, 2000 lodged by the present applicant.

Titanium nitride has been proposed as a material that might be suitable for use in forming the arm through which the electric (heating) current is passed. That material is known to be suitable for use in the fabrication of semi-conductor devices and it possesses a coefficient of thermal expansion that is in the order required to produce desired bending characteristics.

However, it has been determined that, in order to maximise printer operating efficiency, a high temperature should be generated in the thermal actuator over a short period of time, typically less than 2 micro seconds, and this imposes a limit on the use of titanium nitride. Titanium nitride is known to oxidise at a temperature of around 600° C. and this imposes a constraint on the use of that material.

It is in this context that the titanium-aluminium nitride composition has been found to be suitable, having as it does an oxidation temperature in the order of 900° C.

What is claimed is:

1. An actuator element forming a portion of a micro electro-mechanical device and which comprises a movable arm that is connected at one end to a substrate and which is formed at least in part from a titanium-aluminium nitride composition.

2. The actuator element as claimed in claim 1 wherein the composition contains aluminium in an amount not greater than 55% of the total titanium-aluminium composition.

3. The actuator element as claimed in claim 1 wherein the aluminium is present in the composition in an amount equal to about 20% of the total titanium-aluminium composition.

4. The actuator element as claimed in claim 1 when formed by reactively sputtering material from a titanium-aluminium alloy in the presence of nitrogen gas.

* * * * *